US005086810A

United States Patent [19]

Carroll

[11] Patent Number: 5,086,810

[45] Date of Patent: Feb. 11, 1992

[54] ULTRA-SONIC REED CLEANING SYSTEM

[75] Inventor: Patrick R. Carroll, Greenwood, S.C.

[73] Assignee: Milliken Research Corporation, Spartanburg, S.C.

[21] Appl. No.: 933,876

[22] Filed: Nov. 24, 1986

Related U.S. Application Data

[62] Division of Ser. No. 791,792, Oct. 28, 1985, abandoned.

[51] Int. Cl.[5] ..... D03J 1/02; B08B 3/12; B01F 11/02

[52] U.S. Cl. ..... 139/1 C; 134/184; 366/127; 68/355

[58] Field of Search ..... 139/1 C; 134/184, 130, 134/136; 366/127; 68/355

[56] References Cited

U.S. PATENT DOCUMENTS 2,842,143 7/1958 Kearney .
2,949,121 8/1960 Kearney .
3,033,710 5/1962 Hightower et al. .
3,101,089 8/1963 Brown et al. .
4,527,596 7/1985 Kagi ..... 139/1 C

FOREIGN PATENT DOCUMENTS 37-4569 6/1962 Japan .
45-12961 5/1970 Japan .
45-18762 6/1970 Japan .
824538 12/1959 United Kingdom .

*Primary Examiner*—Andrew M. Falik
*Attorney, Agent, or Firm*—Earle R. Marden; H. William Petry

[57] ABSTRACT

An ultra-sonic weaving machine reed cleaner in which the cleaner is moved adjacent the weaving machine and the reed is cleaned without disturbing the thread-up of the warp yarn in the reed. The reed cleaner consists of three bins in which the reed consecutively is placed to wash it, rinse it and then blow it dry. A plurality of transducers are placed in contact with the bottoms of the washing and rinsing bins to enhance the action of the washing and rinsing fluid.

4 Claims, 3 Drawing Sheets

ULTRA-SONIC REED CLEANING SYSTEMThis application is a division of U.S. patent application Ser. No. 791,792, filed on Oct. 28, 1985, entitled ULTRA-SONIC REED CLEANING SYSTEM, now abandoned.

This invention relates generally to ultra-sonic cleaning of weaving machine reeds and in particular, to ultra-sonic cleaning of the reeds of a loom without removing the warp yarn from the reed.

Prior to this invention, loom reeds have been ultra-sonically cleaned to remove the sizing and finish deposited thereon by the warp yarn being woven by cutting the warp yarn, removing the reed from the loom and taking the reed to a remote position to be cleaned. This, of course, required a considerable amount of time, since the warp yarn on the loom then had to be re-strung through the reed.

Therefore, it is an object of the invention to provide an ultra-sonic reed cleaning system in which the reed is cleaned at the loom without disengaging the warp yarn from the reed.

Other objects and advantages of the invention will become readily apparent as the specification proceeds to describe the invention with reference to the accompanying drawings, in which.

Figure 1:
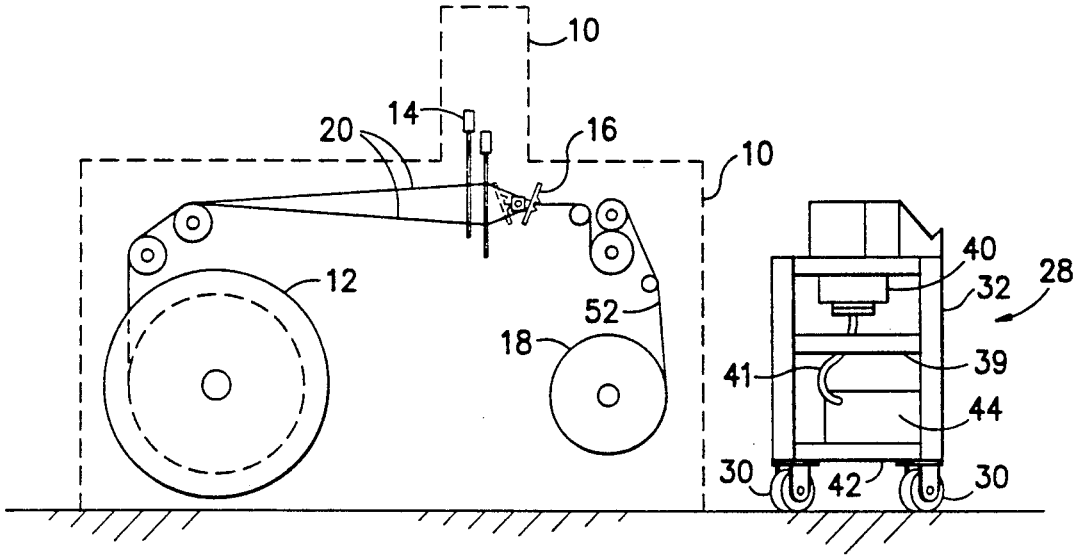
FIG. 1 is a schematic side elevation view of a loom with an ultra-sonic reed cleaner adjacent thereto.

Looking now to FIG. 1, the reference numeral 10 represents a conventional air jet loom having a warp beam 12, heddles 14, a reed 16 and a fabric take-up roll 18. Preferably, the invention concerns an air jet loom but obviously can be employed with any loom which requires cleaning of the reed.

As is well known in the art, the reed 16 is a comb-like device which spaces the warp yarn 20 in the desired order and also places each succeeding filling thread against that already woven. The reed usually consists of a top and bottom rib 22 of metal into which flat metal blades or wires 24 are set. The space between two adjacent wires is called a dent and the count or fineness of the reed is calculated by the number of dents per inch. The warp 20 is drawn through the dents and the sizing and/or finish in the yarn tends to accumulate in the dents. This accumulation is especially bad in the area below the weft tunnel 26 in the reed.

When it is desired to clean the size, finish and/or lint from the dents in the reed, the ultra-sonic reed cleaner 28 is moved on wheels 30 to a position adjacent the front or fabric side of the loom 10 as shown in FIG. 1. The size and number of ultra-sonic components on the ultra-sonic cleaner 28 depends primarily on the width of the reed to be cleaned.

Figure 3:
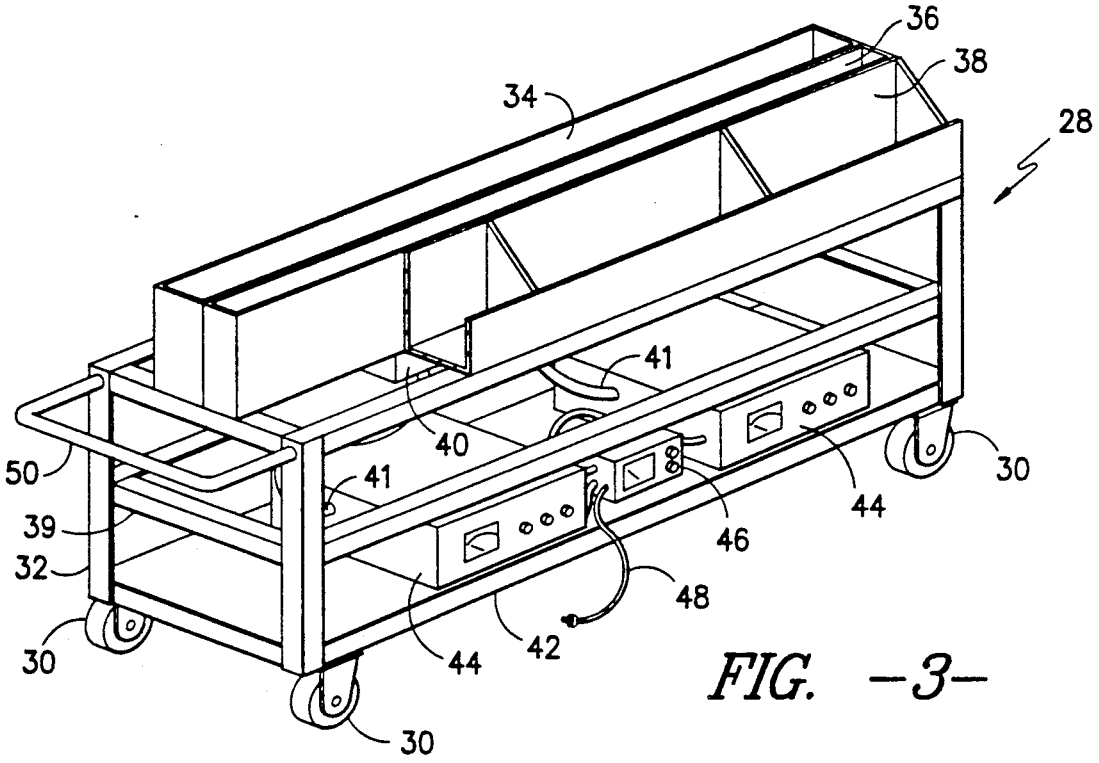
FIG. 3 is a perspective view of the ultra-sonic reed cleaner.
Figure 4:
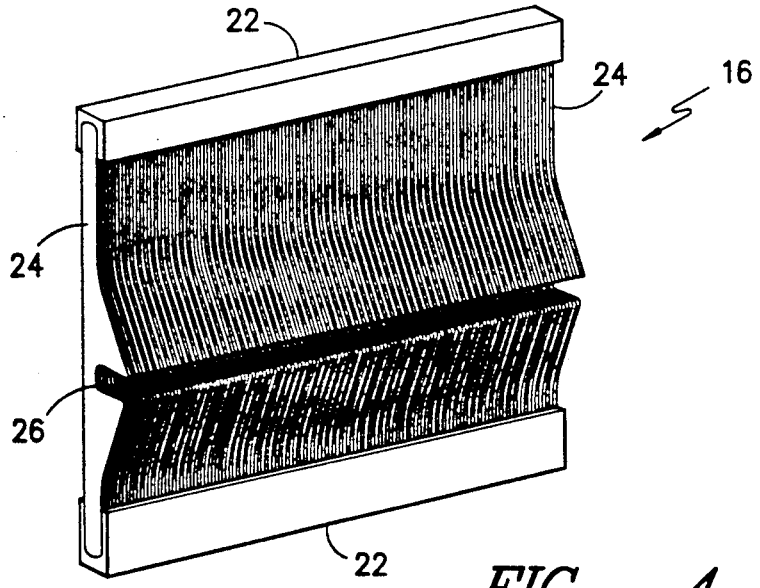
FIG. 4 is a perspective view of a typical reed for an air jet loom.

Looking at FIG. 3, the ultra-sonic cleaner 28 is shown in perspective with wheels 30 mounted thereon for easy movement of the cleaner. The cleaner basically consists of a rectangular metal frame 32 on top of which is located the cleaning bins 34, 36 and 38. Bin 34 is the primary bin for insertion of the reed 16 for washing in a surfactant cleaning solution. Bin 36 is basically for rinsing the washed reed and bin 38 is for a final blowing of the reed with high pressure air from a high pressure air source not shown to remove any retained particles and liquid. Mounted directly below the bins 34, 36 and 38, above a shelf 39, are a plurality of transducers 40 which supply ultra-sonic vibration or energy to the bins 34 and 36. Mounted below each of the transducers on shelf 42 and connected thereto by cable 41, is its generator 44. Located on the shelf 42 is a switching device 46 supplied 110 A.C. via conduit 48 to alternately switch the current from one generator to the other to cut down on the amount of wiring necessary to operate the cleaner 28. A handle 50 is mounted to the upper portion of the frame 32 to and in the movement of the cleaner 28.

Figure 2:
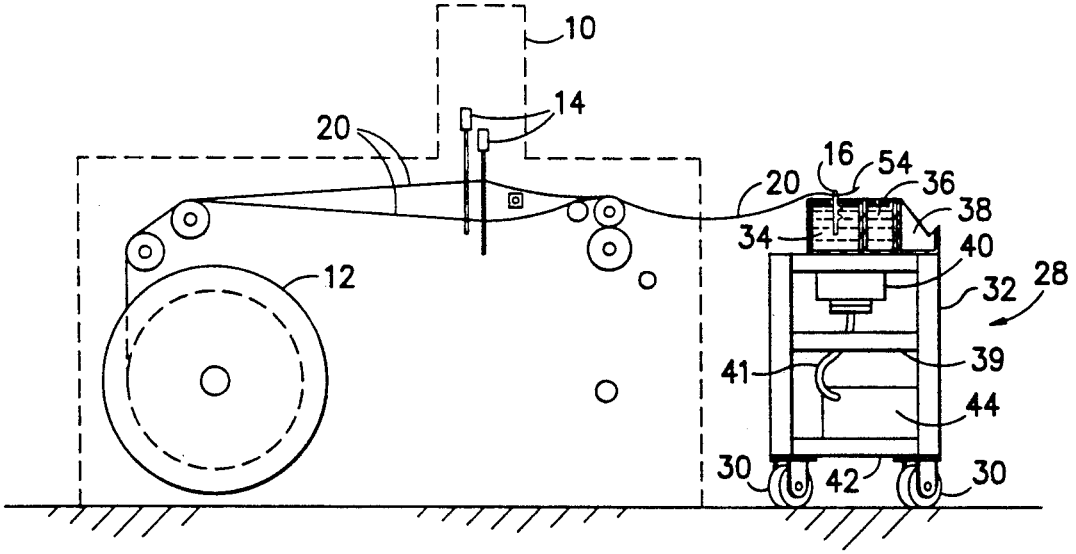
FIG. 2 is a view similar to FIG. 1 showing the loom reed disposed in the reed cleaner.
Figure 5:
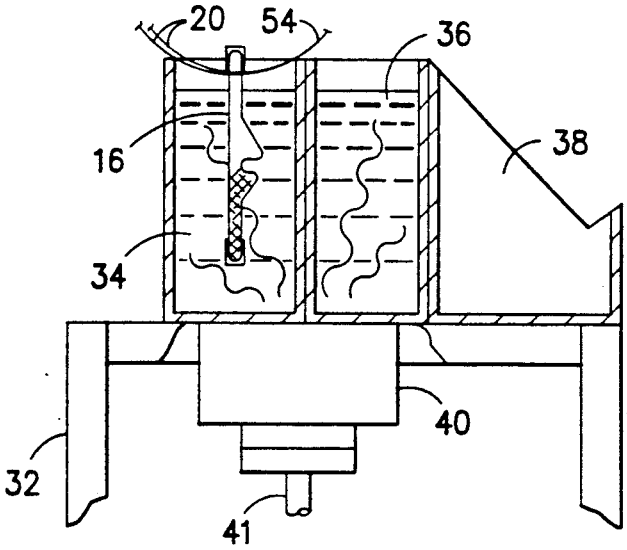
FIG. 5 is an enlarged cross-section view of the reed cleaner with the reed located in the cleaning compartment.

When it is desired or time to clean the reed 16, the loom 10 is stopped and the ultra-sonic cleaner 28 is moved adjacent the front end of the loom as shown in FIG. 1. Then, the woven fabric 52 is severed about 3 inches from the last weft insertion leaving a strip 54 of woven fabric attached to the weft yarn. Then, the reed 16 is removed from its support and the warp beam is let off to allow warp yarn to be unwound therefrom as the reed 16 is pulled towards the cleaner 28 to drop the reed into the cleaning bin 34. The conduit 48 is then plugged into a suitable electrical source and the switching mechanism 46 activated to alternately supply voltage to the selected generator 44. The reed 16 is now in the position shown in FIGS. 2 and 5 with the transducer 40 energized to supply ultra-sonic vibration to the bath in the bin 34. The ultra-sonic energy being supplied to the bath in the bin 34 excites the molecules in the bath to enhance the cleaning of the size, finish, etc. from the dents of the reed 16.

Figure 6:
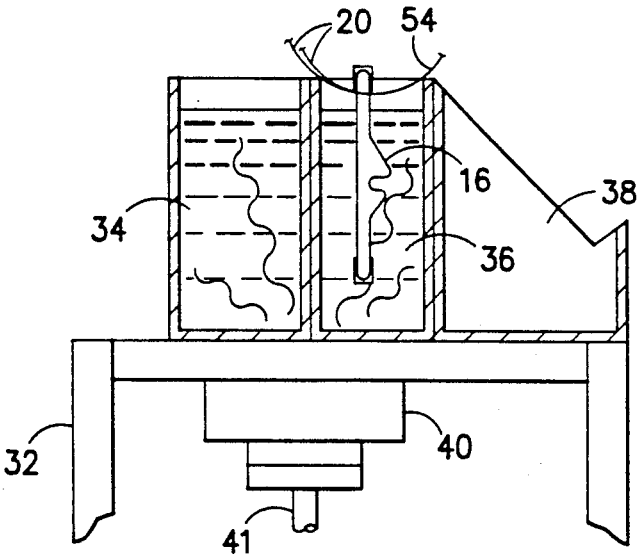
FIG. 6 is a view similar to FIG. 5 showing the reed in the rinsing compartment; and, FIG. 7 is similar to FIGS. 5 and 6 showing the reed being blown clean after washing.
Figure 7:
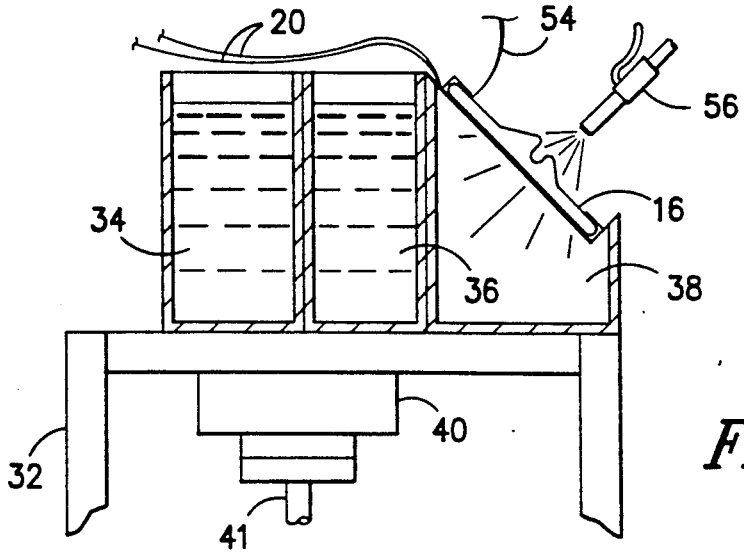

When the reed 16 has been in the bin 34 for a time sufficient to clean same, it is removed and placed in the rinse bin 36 as shown in FIG. 6. From the rinse bin 36, the reed 16 is placed on top of the bin 38 and blown clean of liquid and contaminants by high pressure air from an air nozzle 56 from a high pressure air source, not shown.

Once the reed 16 has been cleaned, it can be removed from the cleaner 28, placed back into its support in the loom, the cleaner 28 removed, the strip 54 connected to a take-up beam 18 and the loom restarted with warp yarn already threaded through the dents of the reed 16.

It can readily be seen that an ultra-sonic cleaning apparatus has been described which is simple and readily useable at the loom. The loom reeds are cleaned without excessive down time and the re-threading of the reed has been eliminated.

Although the preferred embodiment of the invention has been described in detail, it is contemplated that many changes may be made without departing from the scope or spirit of the invention and I desire to be limited only by the claims.

I claim:

1. A moveable ultrasonic apparatus for servicing loom reeds at the loom with the warp yarns remaining in the reeds comprising: an elongated wheeled cart; a first elongated tank for containing a cleaning liquid carried by said cart accommodating a loom reed for cleaning; a second elongated tank for containing a rinsing liquid carried by said cart adjacent and in alignment with said first elongated tank accommodating a loom reed for rinsing; transducer means carried by said cart beneath said first and second tanks for driving said cleaning liquid for ultrasonic cleaning of said loom reed and said rinsing liquid for rinsing said loom reed; and generator means supplying power to said transducer means carried by said cart.

2. The structure set forth in claim 1 including an elongated receptacle for air cleaning and drying of said loom reed carried by said cart.

3. The structure set forth in claim 1 wherein said first and second tanks are closely adjacent each other and vertically disposed for receiving said loom reed in an upright position for cleaning and rinsing respectively, and a plurality of aligned transducers spaced along said first and second tanks each transducer being in driving relation with both a portion of said first tank and an adjacent portion of said second tank.

4. The structure set forth in claim 1 wherein a single generator sequentially drives each of said transducers.

* * * * *